US007546897B2

(12) United States Patent
Takebe et al.

(10) Patent No.: US 7,546,897 B2
(45) Date of Patent: Jun. 16, 2009

(54) SPEAKER DIAPHRAGM AND METHOD OF MANUFACTURING SPEAKER DIAPHRAGM

(75) Inventors: Toru Takebe, Tokyo (JP); Kunihiko Tokura, Tokyo (JP); Masaru Uryu, Chiba (JP)

(73) Assignee: Sony Corporation, Tokyo (JP)

( * ) Notice: Subject to any disclaimer, the term of this patent is extended or adjusted under 35 U.S.C. 154(b) by 458 days.

(21) Appl. No.: 11/457,681

(22) Filed: Jul. 14, 2006

(65) Prior Publication Data

US 2007/0017736 A1 Jan. 25, 2007

(30) Foreign Application Priority Data

Jul. 21, 2005 (JP) ..... 2005-211522

(51) Int. Cl.
*H04R 1/00* (2006.01)
*H04R 7/00* (2006.01)

(52) U.S. Cl. ..... 181/167; 181/170; 181/173; 381/423

(58) Field of Classification Search ..... 181/167, 181/173, 170; 381/423
See application file for complete search history.

(56) References Cited

U.S. PATENT DOCUMENTS 6,863,153 B1 * 3/2005 Hayakawa et al. ..... 181/173
7,315,628 B2 * 1/2008 Kuribayashi et al. ..... 381/424
2003/0093891 A1 * 5/2003 Ajiki ..... 29/594
2004/0062406 A1 * 4/2004 Sakamoto ..... 381/172
2004/0154862 A1 * 8/2004 Carlson ..... 181/293
2006/0008111 A1 * 1/2006 Nagaoka ..... 381/423
2008/0027158 A1 * 1/2008 Ishida et al. ..... 523/223
2009/0028376 A1 * 1/2009 Saito et al. ..... 381/423

FOREIGN PATENT DOCUMENTS

JP 5-153692 6/1993
JP 11-215589 8/1999
JP 2000-184492 6/2000

* cited by examiner

*Primary Examiner*—Jeffrey Donels
*Assistant Examiner*—Christina Russell
(74) *Attorney, Agent, or Firm*—Oblon, Spivak, McClelland, Maier & Neustadt, P.C.

(57) ABSTRACT

A speaker diaphragm made of a resin containing a thermoplastic polymeric material is provided. The speaker diaphragm includes a changed portion formed on the diaphragm that is molded using the resin. The changed portion is formed by partially changing physical properties of the thermoplastic polymeric material for dispersing local vibrations based on a characteristic of local vibrations measured in advance.

12 Claims, 16 Drawing Sheets

SPEAKER DIAPHRAGM AND METHOD OF MANUFACTURING SPEAKER DIAPHRAGM

BACKGROUND OF THE INVENTION

1. Field of the Invention

The present invention relates to a resin diaphragm for a loud speaker (hereinafter referred to as speaker diaphragm) used for, e.g., acoustic output.

2. Description of the Related Art

In order to have better frequency characteristics, means have been employed in manufacturing speaker diaphragms, first, of increasing the stiffness of their material, second, of reinforcing them by adding structural change thereto, and third, of coating their surface with a damping agent or the like in a certain pattern, for example.

A demand for a high specific elastic modulus E/ρ (E: elastic modulus, ρ: density) is raised to increase the range of piston movement, and a demand is similarly raised for large internal losses for smoothing frequency characteristics. Furthermore, in order to enhance the elastic modulus, materials prepared by mixing polypropylene materials so far exhibiting relatively large internal losses with highly elastic fibers (e.g., glass fibers or carbon fibers) and fillers (e.g., mica for coloring) have often been used in injection molding and sheet forming.

Furthermore, to enhance the stiffness of the speaker diaphragm, techniques have been proposed to provide a rib on the speaker diaphragm or vary its thickness (see Japanese Patent Application Publication No. H10-352627). Furthermore, for better frequency characteristics, a technique has been adopted to coat the speaker diaphragm with a damping agent in a certain pattern (see Japanese Patent Application Publication No. H11-215589).

Furthermore, it is known that a speaker diaphragm with remarkably superior characteristics compared to a conventional polypropylene molded product can be manufactured when polyethylene is used as polyolefin being a speaker diaphragm material, because it increases the elastic modulus while maintaining the internal losses properly (see Japanese Patent Application Publication No. H05-153692).

SUMMARY OF THE INVENTION

However, when a material prepared by mixing a polypropylene material with a highly elastic fiber and a filler is used as the speaker diaphragm material, there occurs a shortcoming that the specific gravity of the material increases with increasing content of these additives. As a result, enhancement in the specific elastic modulus is suppressed, and at the same time, in injection molding, the flowing length of a resin is reduced, thereby making it difficult to form a thin resin layer. Accordingly, this has further made it difficult for the speaker diaphragm to satisfy the requirements for both of the physical properties mentioned above.

Furthermore, in the techniques disclosed in Patent Application Publication No. H10-352627, when a speaker diaphragm is injection-molded using a polymeric material, flow of the resin is blocked by the presence of such a shape on its way, which particularly makes it difficult to form a thin resin layer. Thus, there is a limit in reducing the weight of the speaker diaphragm. Furthermore, in fabricating a mold for the injection molding, its machining and position accuracy requirements are severer than in conventional molds, naturally making a mold machining process complicated and thus leading to another shortcoming of elevated cost.

Furthermore, in the technique proposed in Japanese Patent Application Publication No. H11-215589, if made of a material such as paper having a superior adhesiveness, such a speaker diaphragm would be acceptable. However, if a speaker diaphragm is made of a resin, particularly, a polyolefin resin, having an inferior adhesiveness, a primer process or the like using a press machine is preferable to be performed, involving a large-scale coating process, and thus this technique would not be practical.

Furthermore, in the technique disclosed in Japanese Patent Application Publication No. H05-153692, due to the fact that it would be difficult to obtain smooth frequency characteristics depending on the shape of the speaker diaphragm, an additional technique may need to be employed to enhance the characteristics.

Accordingly, it is desirable to provide a speaker diaphragm having smooth frequency characteristics by specifically cutting the extensively oriented molecular chains in an ultra-high molecular weight polyolefin to locally change its physical properties.

According to an embodiment of the present invention, there is provided a speaker diaphragm in which a changed portion is formed on a diaphragm that is molded using a resin. The changed portion is formed by partially changing physical properties of a thermoplastic polymeric material in accordance with a characteristic of local vibrations measured in advance, for dispersing the local vibrations.

The speaker diaphragm is formed by using the above-mentioned polyolefin composition as the resin. Furthermore, a technique for causing a localized change in physical properties involves selective heating or selective melting of a surface layer of the diaphragm after the diaphragm has been formed. As a result, the elastic modulus of the heated portion is changed, while the unheated portion maintaining its high elastic modulus. Accordingly, the vibration propagation speed within the diaphragm is intentionally changed, whereby a vibration mode occurring at predetermined frequencies can be controlled. As a result, a diaphragm implementing smoother frequency characteristics can be fabricated.

In this way, according to the present embodiment, after the diaphragm has been molded, the resin surface of the diaphragm is thermally changed to form a physically changed portion. Thus, by partially changing the physical properties, the stiffness of the diaphragm is specifically changed, whereby the physical properties of the diaphragm is controlled partially, to disperse natural vibrations or eigenmode of the diaphragm to enhance and hence smooth its frequency characteristics.

As described above, a speaker using the diaphragm of the present invention can have partial vibrations of the diaphragm dispersed so as to reduce partial vibration peaks and dips that deteriorate its frequency characteristics, whereby an advantage is provided that the frequency characteristics are smoothed.

BRIEF DESCRIPTION OF THE DRAWINGS

FIG. 2 is a diagram showing a configuration of a speaker diaphragm, in which

FIG. 9 is a diagram showing a configuration of an elliptic speaker diaphragm, in which

DETAILED DESCRIPTION OF THE INVENTION

An embodiment of the present invention will now be described in detail below with reference to the drawings.

Figure 1:
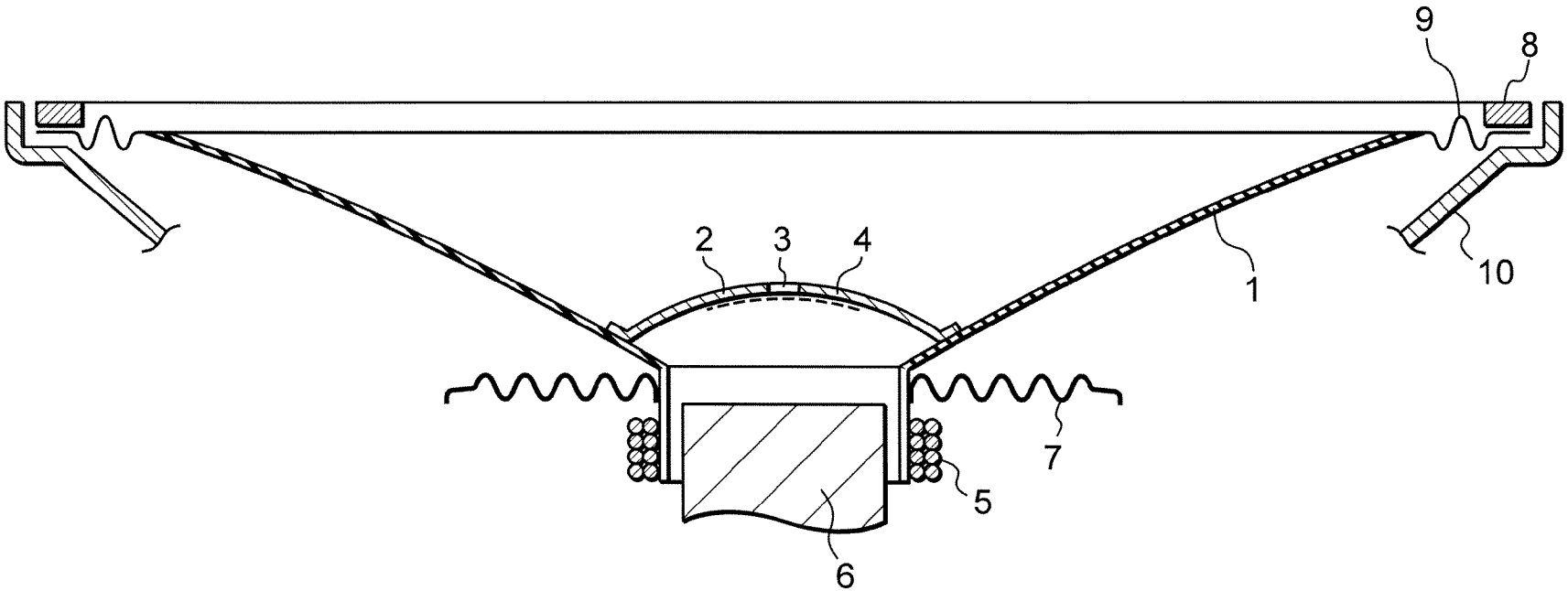
FIG. 1 is a diagram for explaining vibrating parts of a speaker.

FIG. 1 is a diagram for explaining vibrating parts of a speaker. A speaker unit is formed with the speaker vibrating part provided as shown in FIG. 1.

In FIG. 1, a cone 1 as a speaker diaphragm is preferable to be formed into a thin molded part for ease of movement, and also is preferable to be light and stiff. Additionally, the cone 1 is preferable to exhibit appropriate losses called internal losses to reduce peaks and dips as well as transients in the frequency characteristics.

A center cap 2 is provided to prevent from deformation of the cone 1 in a radial direction and entrance of iron powder and dust into clearances. The center cap 2 has a hole 3 formed therein close to the center and has a large-mesh fabric 4 stuck over the hole 3. The hole 3 functions as means of discharging air that expands and compresses with vibration of the cone 1.

The large-mesh fabric 4 serves as a dust proof means that does not disturb air circulation. A voice coil 5 moves up and down around a pole 6 to vibrate the cone 1. A damper 7 properly holds the voice coil 5 around the pole 6. A support paperboard 8 fixes an edge 9 of the cone 1 onto a frame 10.

Figure 2B:
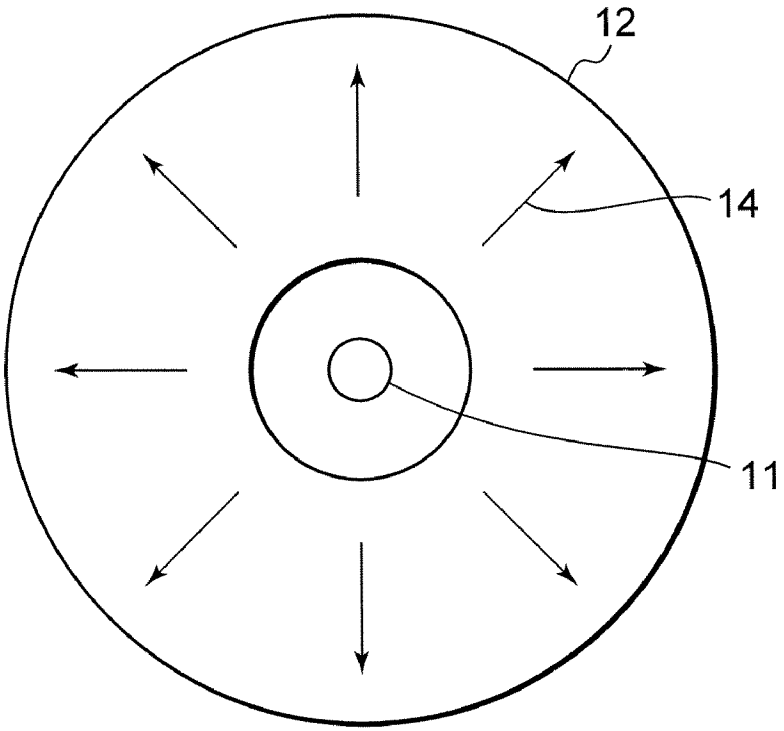
FIG. 2A is a side view and FIG. 2B is a front view.
Figure 2A:
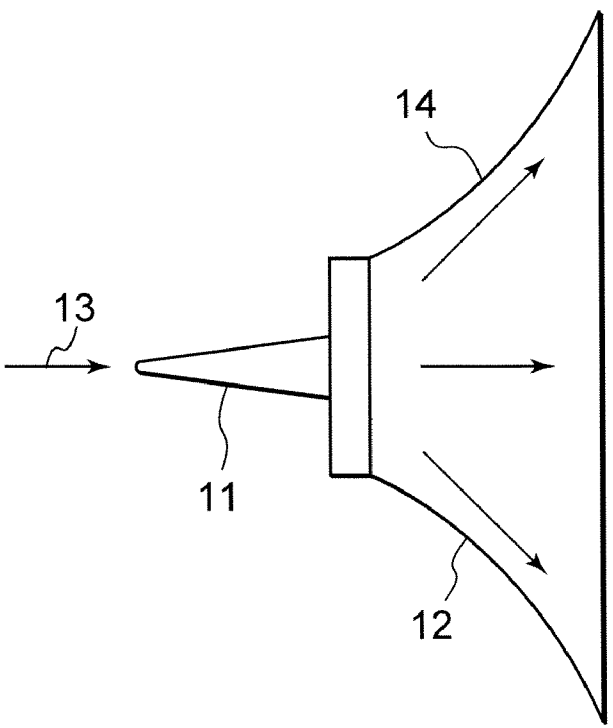

FIG. 2 is a diagram showing a configuration of the speaker diaphragm, in which FIG. 2A is a side view and FIG. 2B is a front view.

In FIG. 2A, a resin 13 is charged into a mold from a gate 11, to shape a cone 12 as the speaker diaphragm. During this process, in the cone 12 shown in FIG. 2B, the resin flows toward the outer circumference of the cone 12 from the gate 11 located at the center. Thus, as indicated by reference numeral 14, the direction of flow and orientation of the resin is a direction from the center to the outer circumference. This diaphragm was prepared by injection-molding a polyolefin composition.

Changed portions 15 (see FIG. 3) are formed on the speaker diaphragm in a manner canceling local vibrations of the speaker diaphragm occurring in the direction of flow and orientation of the resin indicated by reference numeral 14.

Figure 3:
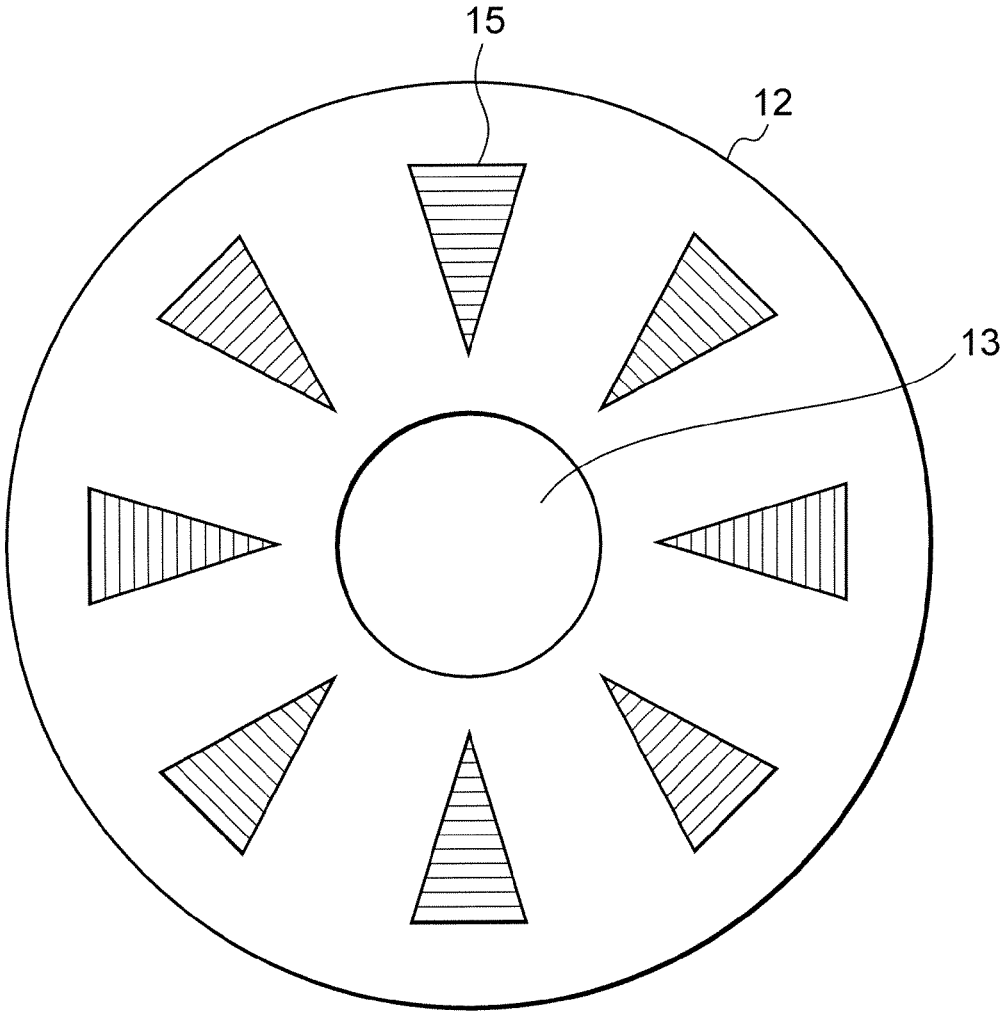
FIG. 3 is a diagram showing changed portions formed on a speaker diaphragm.

FIG. 3 is a diagram showing the changed portions formed on the speaker diaphragm.

In FIG. 3, the changed portions 15 are formed into a pattern in which a pattern element is repeated in a manner dividing the circumference of the cone 12 as the speaker diaphragm radially, according to the shape of the cone 12 as the speaker diaphragm. When the cone 12 as the speaker diaphragm is of a circle or substantially perfect circle, the changed portions 15 are formed as evenly disposed in a manner dividing the circumference of the cone 12 as the speaker diaphragm radially.

For example, the changed portion 15 is formed such that its width maximizes on the outer circumferential side of the cone 12 and minimizes on the inner circumferential side. Furthermore, it is also formed into a triangular pattern having its vertex on the inner circumferential side and its base on the outer circumferential side. The triangular pattern that serves as the changed portion 15 is patterned to be repeated tangentially to the circumference.

Figure 4:
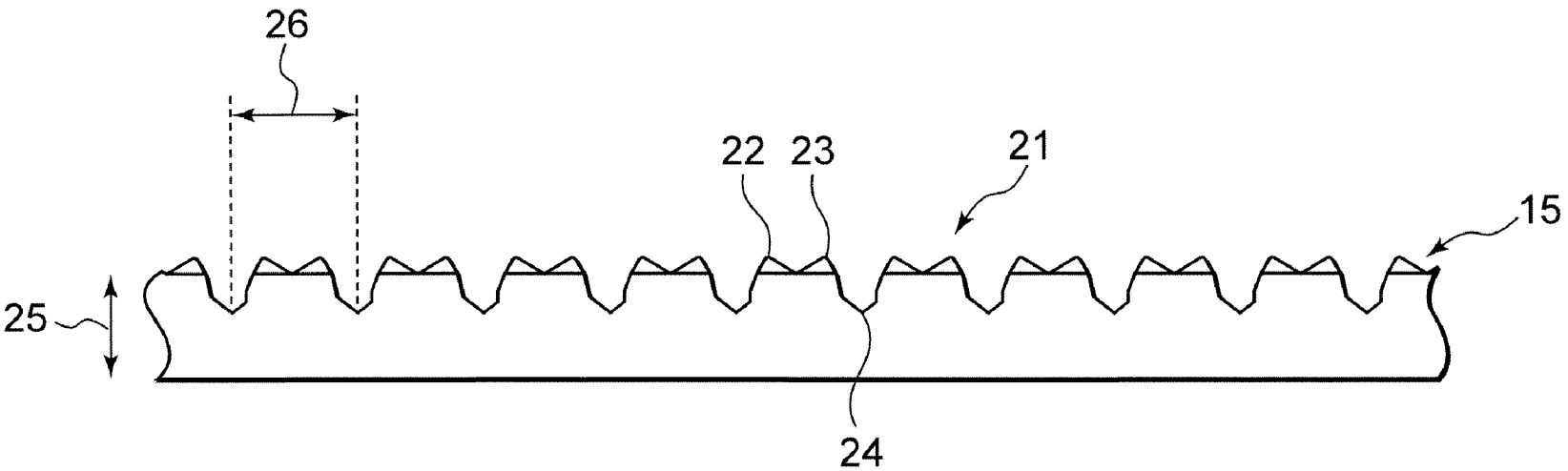
FIG. 4 is a diagram showing an example of the sectional view of a changed portion.

FIG. 4 is a diagram showing an example of a sectional view of the changed portion.

In FIG. 4, the changed portion 15 has a dip 24 and bumps 22, 23 repeatedly formed due to melting and swelling caused by the cone 12 being irradiated with a laser beam, such as indicated by reference numeral 21. The dip 24 and bumps 22, 23 are formed as pitched at 0.5 mm as indicated by reference numeral 26, in and on a surface of the cone 12 having a thickness of 0.35 mm as indicated by reference numeral 25.

Figure 5:
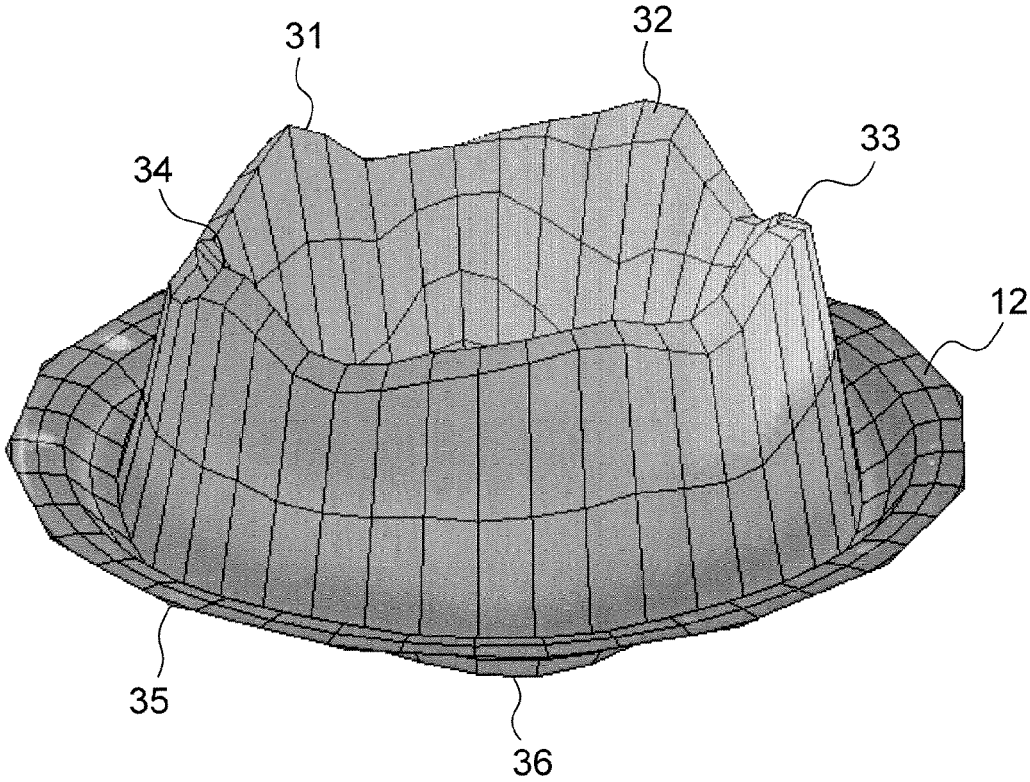
FIG. 5 is a diagram showing a vibration mode in a speaker unit using a speaker diaphragm with no changed portion.

FIG. 5 is a diagram showing a vibration mode in a speaker unit using a speaker diaphragm with no changed portion.

In FIG. 5, four relatively large peaks 31, 32, 33, 34 appear upward in the circumferential direction of the cone 12, and also two relatively large bottoms 35, 36 appear downward in the circumferential direction of the cone 12. The reason why the relatively large peaks and bottoms appear in this way is that the flow and orientation of the resin occur in the predetermined direction as indicated by reference numeral 14 shown in FIG. 2 so intensely that the vibration characteristics are not smoothed, resulting in local vibrations.

Figure 6:
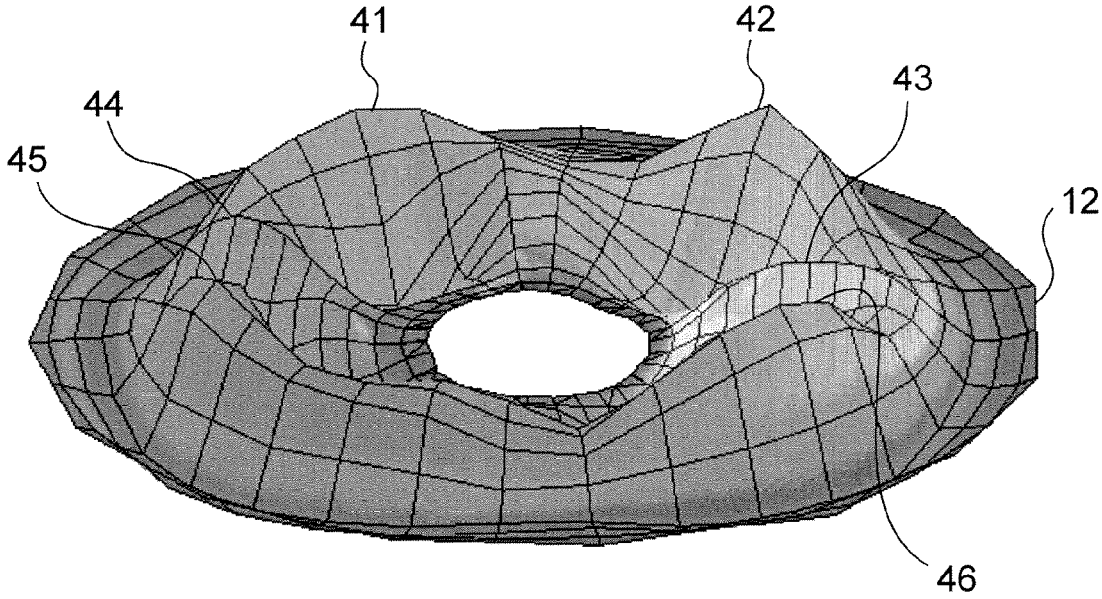
FIG. 6 is a diagram showing a vibration mode in a speaker unit using a speaker diaphragm with changed portions.

FIG. 6 is a diagram showing a vibration mode in a speaker unit using the speaker diaphragm with the changed portions.

In FIG. 6, six peaks 41, 42, 43, 44, 45, 46 appear upward, which are dispersed in relatively small amounts in the circumferential direction of the cone 12. The reason why the peaks appear as being dispersed in relatively small amounts in this way is that the changed portions 15 are formed, in FIG. 3, into a pattern in which a pattern element is repeated in a manner dividing the circumference of the cone 12 as the speaker diaphragm radially, to divide the local vibrations to smooth the vibration characteristics.

A carbon dioxide laser is used to form the changed portions 15. How selective changes should be patterned is determined by controlling the physical properties at the portions for selective change on the basis of the peaks and bottoms shown in FIG. 5 which are measured in advance, such that the local vibrations causing the peaks and bottoms are divided.

As seen from the peaks and bottoms shown in FIG. 5, concentric partial vibrations had occurred, to cancel each other out to cause dips in the frequency characteristics. In order to overcome this, a technique is employed for dispersing the partial vibrations. In the technique, e.g., the cone 12 is irradiated with the laser in a certain pattern in which its circumference is divided radially, to change the physical properties in that pattern. As a result, the changed portions 15 are formed. This technique is tremendously advantageous in improving the frequency characteristics without changing the weight of the speaker diaphragm.

In the present embodiment, first, a speaker diaphragm is molded using a thermoplastic polymeric material, and then a characteristic of local vibrations of the molded speaker diaphragm are measured. Thereafter, based on the characteristic of the local vibrations measured, data about portions to be changed are generated for dispersing the local vibrations. Further, the speaker diaphragm is irradiated with a laser beam such that the physical properties of its thermoplastic polymeric material are partially changed. Thus, the changed portions are formed.

In the method of manufacturing a resin speaker diaphragm using a thermoplastic polymeric material as mentioned above, by dispersing the partial vibrations, a speaker diaphragm having smooth frequency characteristics can be manufactured.

The embodiment of the present invention will further be described below on the basis of specific experimental results.

Figure 7:
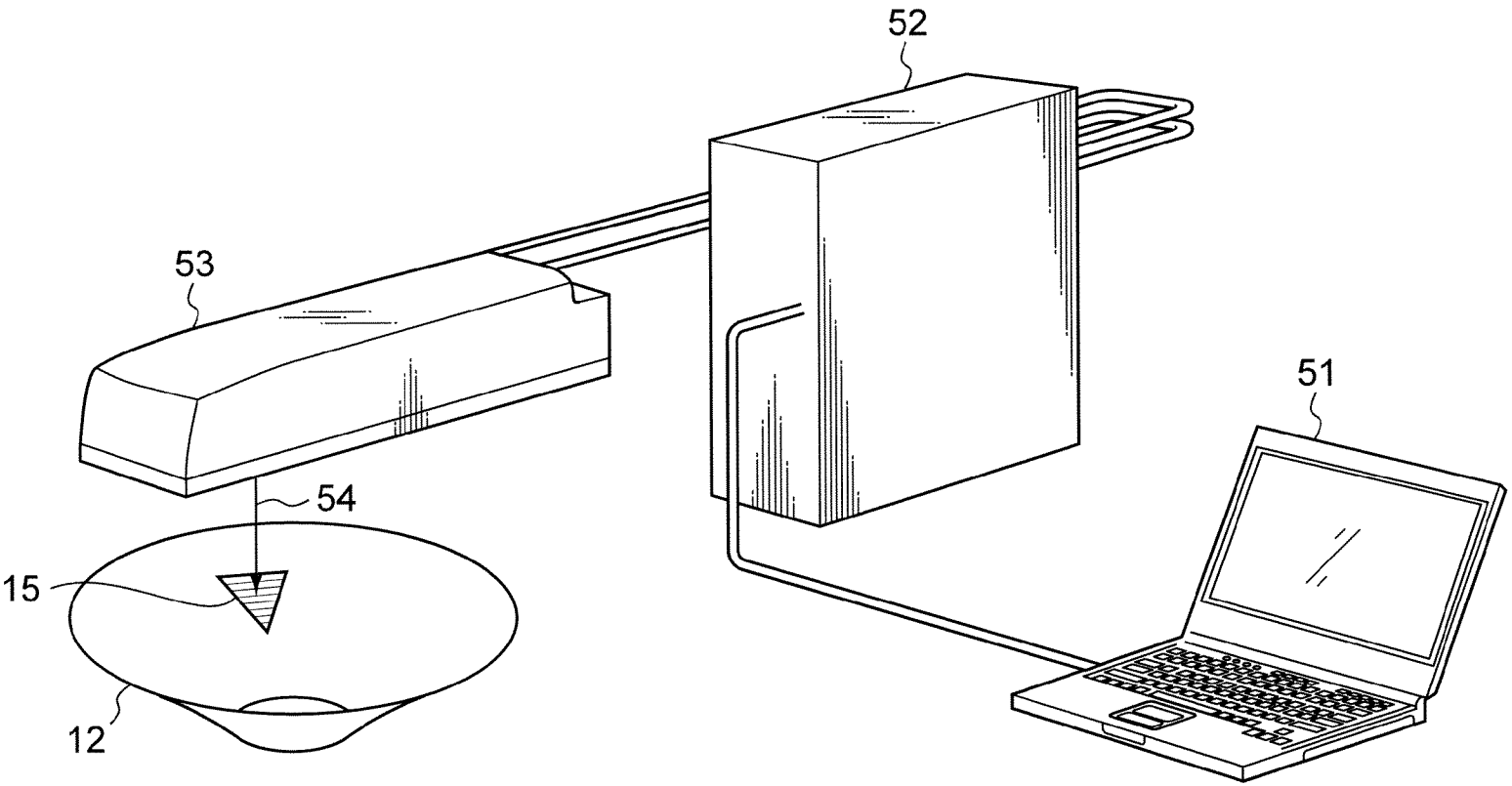
FIG. 7 is a diagram showing a configuration example of a changed-portion forming apparatus.

FIG. 7 is a diagram showing a configuration example of a changed portion forming apparatus.

FIG. 7 shows the apparatus used to form the selective changed portions 15 over the cone 12 as the speaker diaphragm. This apparatus includes a marker 53 as a carbon dioxide laser beam machine, a controller 52, and a controlling PC (personal computer) 51, and is configured to form an arbitrary geometric pattern through irradiation of a laser beam 54 under proper irradiation conditions.

In FIG. 7, a specific geometric pattern and laser beam machining conditions are entered into the controlling PC 51, whereby a drawing command is outputted to the controller 52. The controller 52 converts the drawing command received into a command for irradiating the cone 12 with the laser beam 54 at an arbitrary position, for supply to the marker 53 as the laser beam machine. As a result, the marker 53 is controlled such that the laser beam can be emitted to draw the same pattern element as the geometric pattern that is displayed on the PC 51 screen.

While the marker 53 as the laser beam machine comes in several types, it is known that there is some compatibility between the cone 12 to be machined and the wavelength of a laser beam used for machining. In the case of the resin used for the current experiments and easy to form an oriented layer at the time of its injection, e.g., a special polyolefin resin prepared by subjecting an ultra-high molecular weight polyolefin and a high molecular weight olefin to multi-stage polymerization, i.e., Lubmer L3000 (manufactured by Mitsui Chemicals Inc.), a carbon dioxide laser was suitable.

The reason is that a laser is required for mass production, which satisfies the needs for melting the cone 12 to a certain depth on one hand, and for controlling output and operating speed as well as achieving short machining time on the other. With YAG (yttrium aluminum garnet) lasers, it took time to produce satisfactory results, whereas carbon dioxide lasers permitted setting of practical conditions. The carbon dioxide laser beam machine used in the present embodiment has the following specifications. The machine uses a carbon dioxide laser having a wavelength of 10.6 μm, has an average output of 30 W, and writes a pattern over a writing area of 110 mm×110 mm, at a maximum printing speed of 600 characters per second.

EXPERIMENT EXAMPLE 1

A speaker diaphragm used for analysis of Experiment Example 1 is of a cone type as has been presented in FIG. 2, having an outside diameter of 115 mm and a thickness of 0.35 mm. As shown in FIG. 2, the resin was shaped by injection molding, in a manner spreading out evenly from the gate 11 at the center to a thin-layered diaphragm part, over the cone 12.

The injection molding machine used is an ultrahigh-speed molding machine having the following specifications: the maximum injection pressure is 2,800 kg/cm$^2$; the maximum injection speed is 1,500 mm/sec; the rise speed is 10 msec; the mold clamping force is 160 tons; and the screw diameter is ϕ32 mm. The resin used is the special polyolefin resin, i.e., Lubmer L3000 (manufactured by Mitsui Chemicals Inc.), by which an oriented layer is readily formable when injected. This special polyolefin was prepared by subjecting an ultra-high molecular weight polyolefin and a high molecular weight olefin to multi-stage polymerization.

The resin was charged from a hopper of the injection molding machine under the following injection conditions. The temperature of a plasticizing screw section was 220° C.; the injection speed was 1,500 mm/sec; and the mold temperature was 45° C. The injection molding was performed under the above conditions, and the resultant speaker diaphragm was then ejected.

Through measurement of a vibration mode using the thus injection-molded speaker diaphragm, it was shown that partial vibrations such as seen from the peaks and bottoms shown in FIG. 5 had occurred, and thus it was decided to provide a geometric pattern for canceling these partial vibrations. For example, changed portions 15 each having the pattern element shown in FIG. 3 were provided on the cone 12 as the speaker diaphragm.

In the present embodiment, a pattern was formed by using the carbon dioxide laser, under the machining conditions: the output was 80% and the scanning speed was 750 mm/sec.

The physical property values obtained therefor are shown in Table 1.

TABLE 1

| | Present Example (Lubmer) | | Comparison Example (polypropylene) | |
|---|---|---|---|---|
| | Before Laser Irradiation | After Laser Irradiation | Before Laser Irradiation | After Laser Irradiation |
| Specific Gravity | 0.952 | ← | 1.07 | ← |
| Young's modulus | 6.95 | 4.67 | 5.77 | 4.17 |
| Internal Loss | 0.016 | 0.021 | 0.071 | 0.077 |

According to Table 1, a comparative example (polypropylene) exhibited a relatively small reduction in Young's modulus with internal losses changing little, whereas the present embodiment (Lubmer) exhibited a relatively large reduction in Young's modulus with internal losses growing relatively large. From this Table 1, it is seen that in the present embodiment, irradiation of the laser resulted in a larger rate of change in the physical properties than in other resins, and thus that the oriented layer is effectively disconnected.

A vibration mode in a speaker unit using the diaphragm according to the present embodiment is shown in FIG. 6. The partial vibration peaks are reduced compared to those in FIG. 5, showing the effect of the present embodiment.

Figure 8:
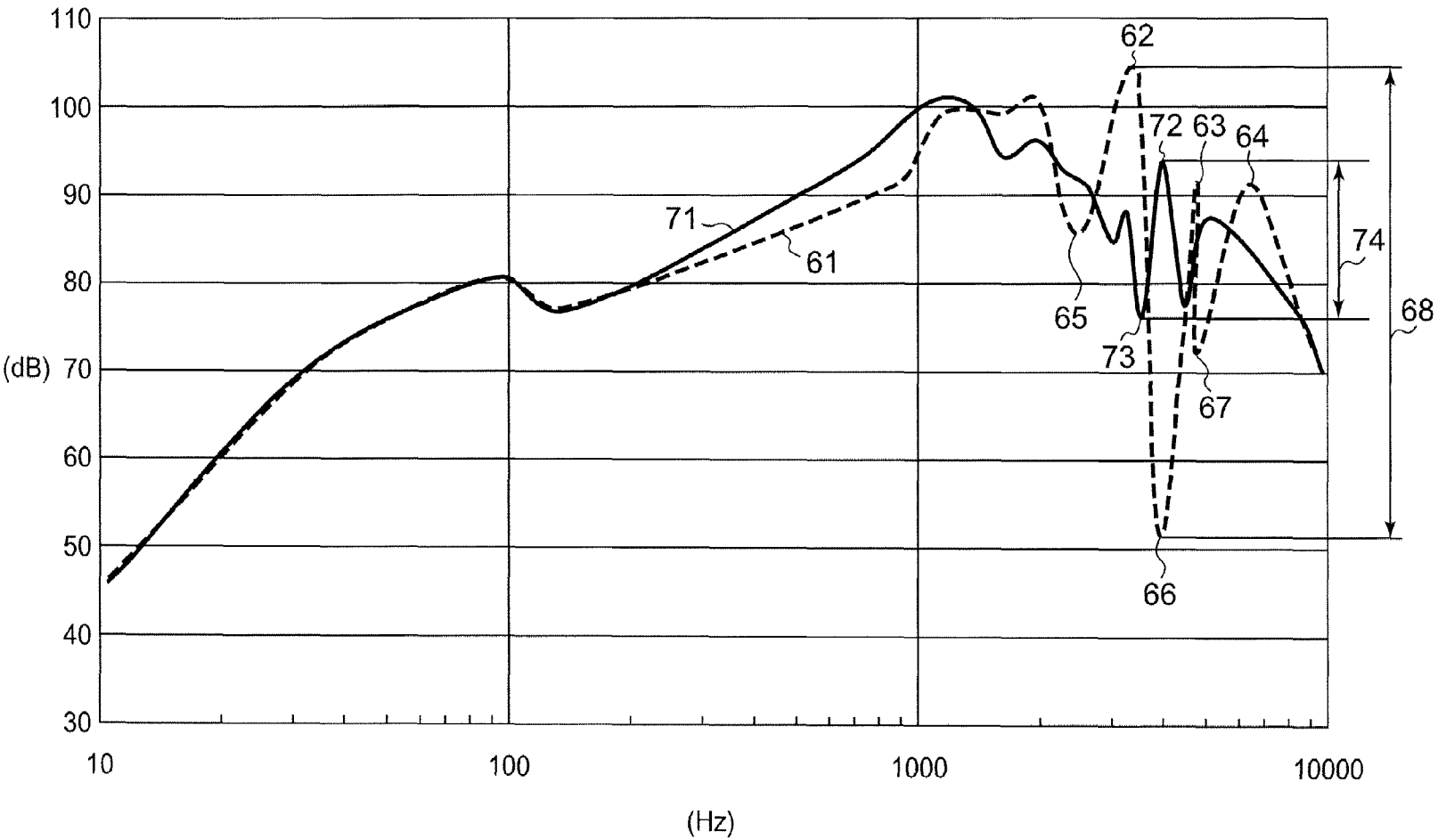
FIG. 8 is a diagram showing frequency characteristics of a speaker unit using a speaker diaphragm with changed portions.

FIG. 8 is a diagram showing frequency characteristics of a speaker unit using the speaker diaphragm with the changed portions.

In FIG. 8, as to the frequency characteristics of the speaker unit using the speaker diaphragm with the changed portions, a speaker diaphragm 61 before the pattern for the changed portions 15 was written with the laser exhibited a dip 65, a peak 62, a dip 66, a peak 63, a dip 67, a peak 64 in a 2-10 kHz range, as shown by the dashed line. By contrast, a speaker diaphragm 71 after the pattern for the changed portions 15 was written with the laser exhibited a dip 73 and a peak 72, as shown by the solid line, with their number reduced.

Furthermore, the speaker diaphragm 61 with no changed portion exhibited a peak-to-dip difference 68 of 50 (dB) or more, whereas the speaker diaphragm 71 with the changed portions exhibited a remarkably reduced peak-to-dip difference 74 of 20 (dB) or less in the 2-10 kHz range, manifesting the effect in the present embodiment.

EXPERIMENT EXAMPLE 2

Figure 9B:
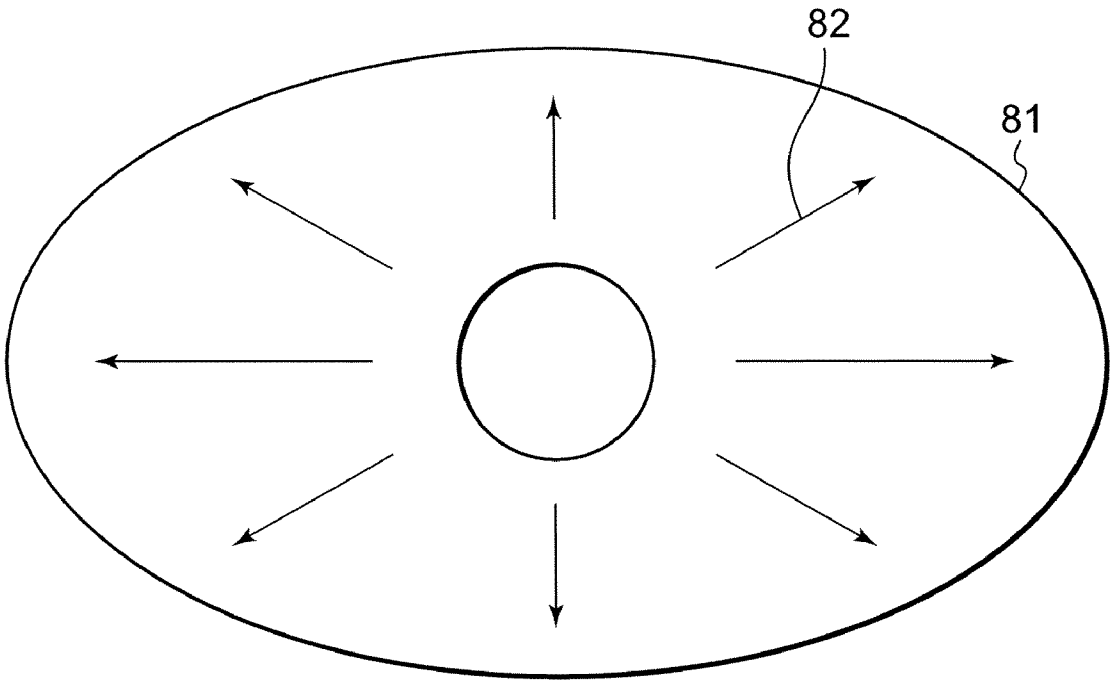
FIG. 9A is a side view and FIG. 9B is a front view.
Figure 9A:
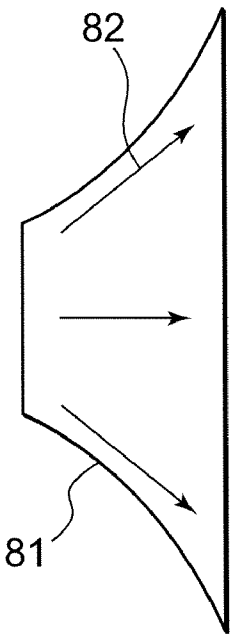

FIG. 9 is a diagram showing a configuration of an elliptic speaker diaphragm, in which FIG. 9A is a side view and FIG. 9B is a front view.

FIG. 9 shows an elliptic, cone-type diaphragm used in this Experiment Example 2. The diaphragm was formed by injection molding under conditions similar to those for Experiment Example 1.

In FIG. 9A, a resin is charged into a mold from a gate similar to that shown in FIG. 2, to shape a cone 81 as a speaker diaphragm. During this process, in the cone 81 shown in FIG. 9B, the resin flows toward the outer circumference of the cone 81 from the gate located at the center. Thus, as indicated by reference numeral 82, the direction of flow and orientation of the resin is a direction from the center to the outer circumference. This diaphragm was prepared by injection-molding a polyolefin composition.

The speaker diaphragm was injection-molded in the above way, and then ejected, after which its vibration modes were measured.

Figure 10:
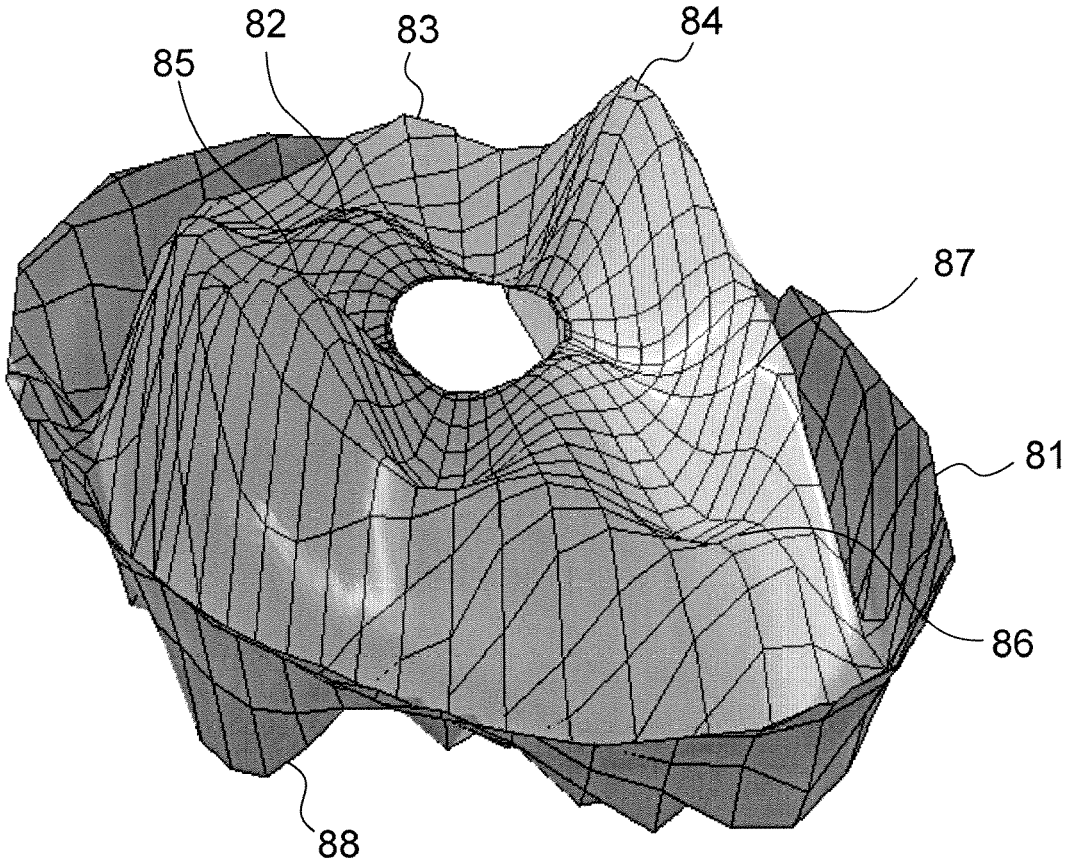
FIG. 10 is a diagram showing a vibration mode in a speaker unit using a speaker diaphragm with no changed portion.

FIG. 10 is a diagram showing a vibration mode in a speaker unit using the speaker diaphragm with no changed portion.

In FIG. 10, six relatively large peaks 82, 83, 84, 85, 86, 87 appear upward in the circumferential direction of the cone 81, and also a single relatively large bottom 88 appears downward in the circumferential direction of the cone 81. The reason why the relatively large peaks and bottom appear in this way is that the flow and orientation of the resin occur in the predetermined direction as indicated by reference numeral 82 in FIG. 9 so intensely that the vibration characteristics are not smoothed, resulting in local vibrations.

Through measurement of the vibration mode using the thus injection-molded speaker diaphragm, it was shown that partial vibrations such as seen from the peaks and bottom shown in FIG. 10 had occurred, and hence it was decided to provide a geometric pattern for canceling these partial vibrations.

Figure 11:
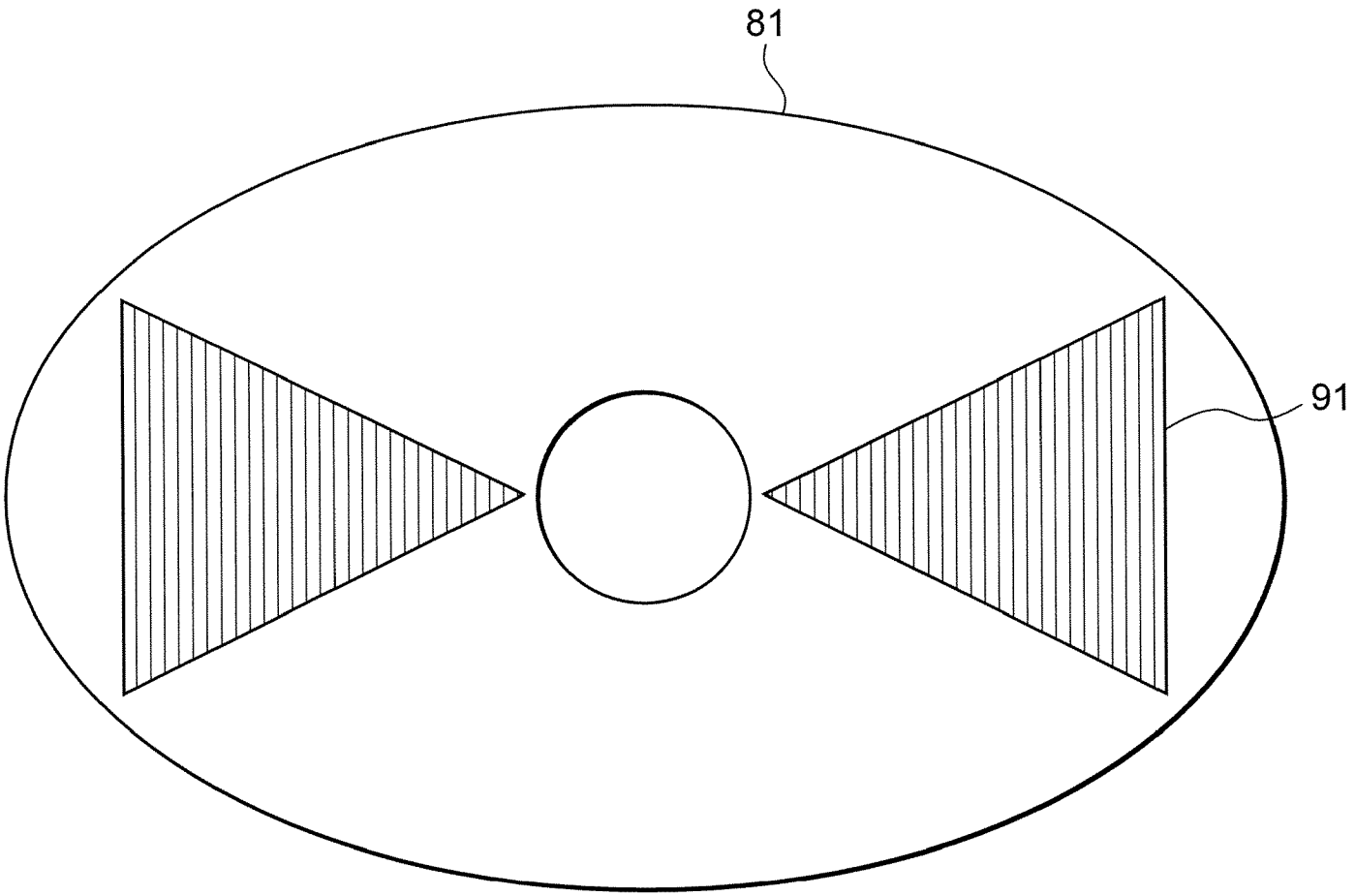
FIG. 11 is a diagram showing changed portions formed on a speaker diaphragm.

FIG. 11 is a diagram showing changed portions formed on the speaker diaphragm.

In FIG. 11, when the cone 81 as the speaker diaphragm is of an ellipse, changed portions 91 are formed as disposed at the locations along a direction toward the foci in such a manner as to divide the circumference of the cone 81 as the speaker diaphragm radially. For example, the changed portion 91 is formed such that its width maximizes on the outer circumferential side of the cone 81 and minimizes on the inner circumferential side. Furthermore, it is also formed into a triangular pattern having its vertex on the inner circumferential side and its base on the outer circumferential side. The triangular pattern that serves as the changed portion 91 is repeated in a tangential direction with respect to the circumference.

In the speaker diaphragm used in Experimental Example 2, it was shown that partial vibrations such as shown in FIG. 10 had occurred, and thus it was decided to provide, e.g., the changed portions 91 so shaped as shown in FIG. 11 for canceling these partial vibrations.

In the present embodiment, the pattern was formed by using the carbon dioxide laser, under the machining conditions: the output was 80% and the scanning speed was 750 mm/sec. After the thus patterned changed portions had been formed, vibration modes were measured.

Figure 12:
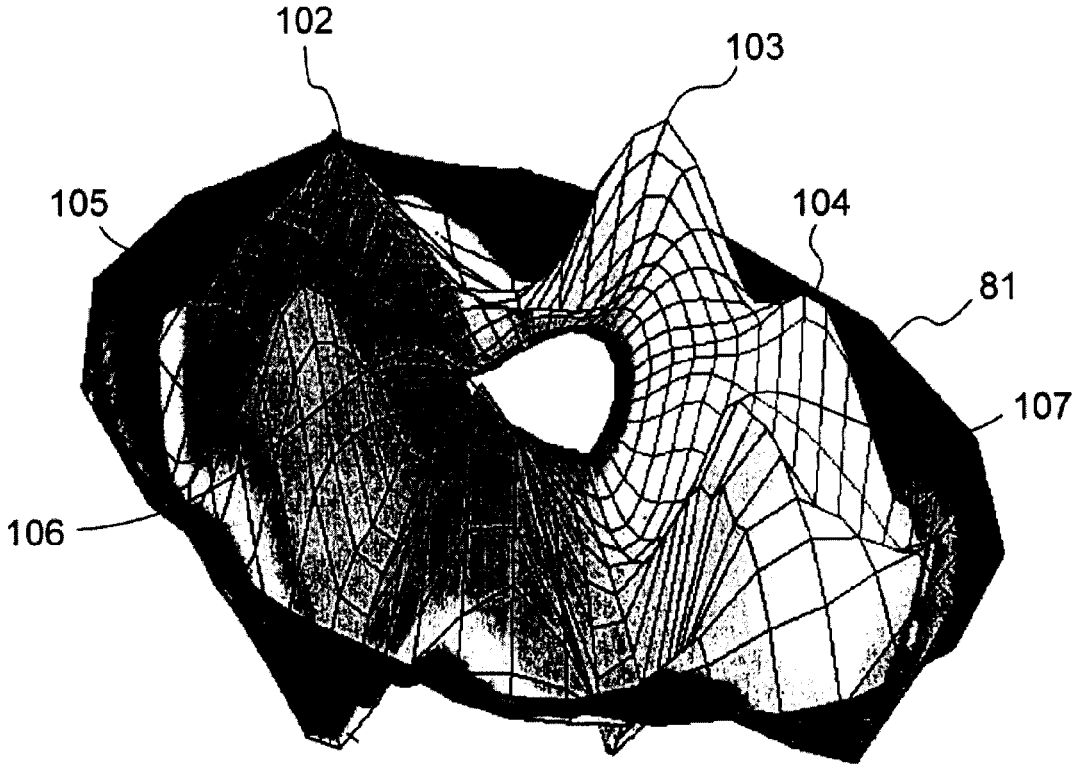
FIG. 12 is a diagram showing a vibration mode in a speaker unit using a speaker diaphragm with changed portions.

FIG. 12 is a diagram showing a vibration mode in a speaker unit using the speaker diaphragm with the changed portions.

In FIG. 12, six peaks 102, 103, 104, 105, 106, 107 dispersed in relatively small amounts appear upward in the circumferential direction of the cone 81. The reason why the peaks appear as dispersed in relatively small amounts in this way is that the changed portions 91 are formed, in FIG. 11, into a pattern in which a pattern element is repeated at the locations along a direction toward the foci in such a manner as to divide the circumference of the cone 81 as the speaker diaphragm radially, according to the shape of the cone 81 as the speaker diaphragm, to divide the local vibrations to smooth the vibration characteristics.

In the vibration mode in the speaker unit using the speaker diaphragm according to the present embodiment shown in FIG. 12, the partial vibration peaks are reduced compared to those in FIG. 10, from which it is seen that the effect of the present embodiment is realized.

Figure 13:
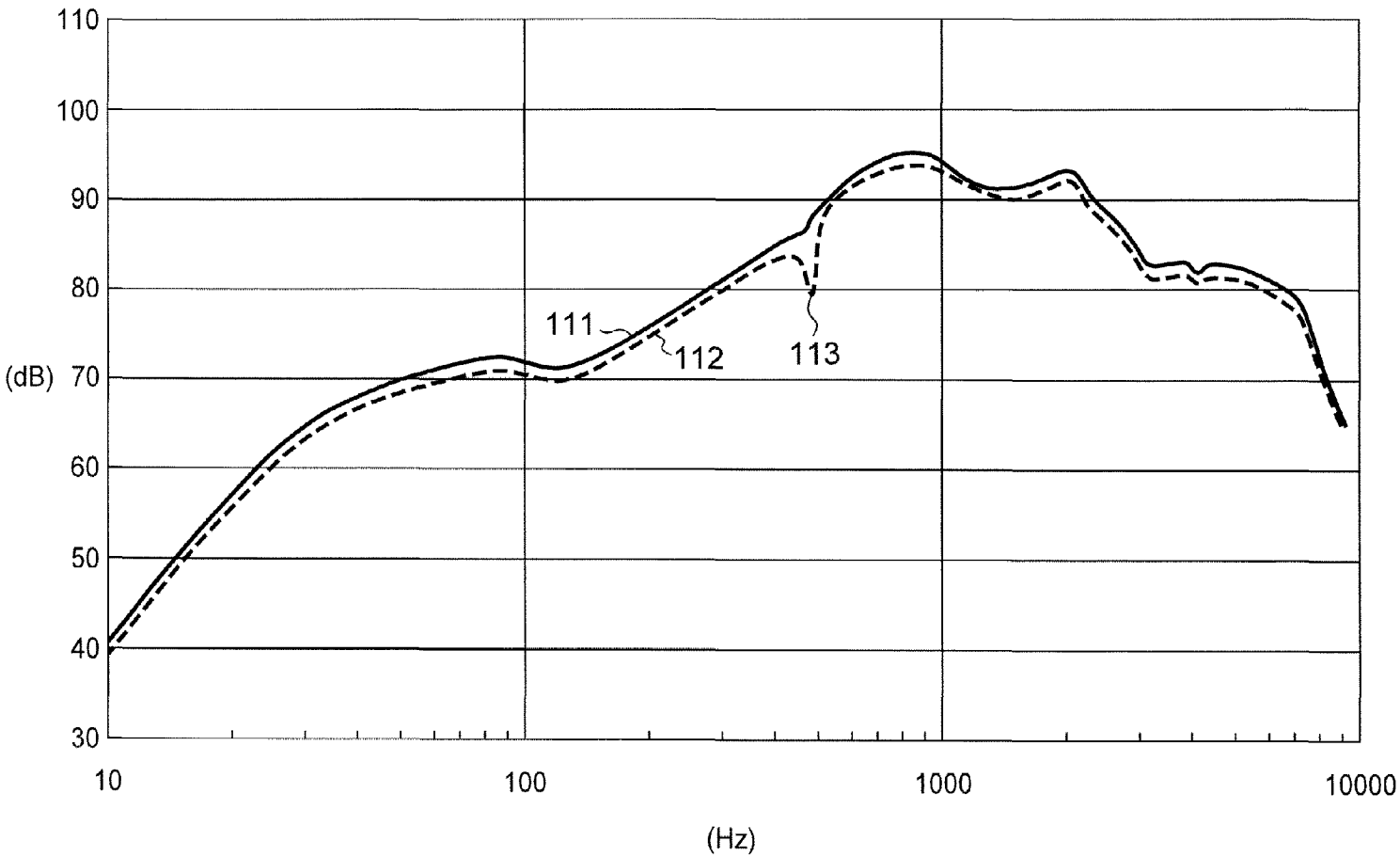
FIG. 13 is a diagram showing frequency characteristics of a speaker unit using a speaker diaphragm with changed portions.

FIG. 13 is a diagram showing frequency characteristics of the speaker unit using the speaker diaphragm with the changed portions.

As to the frequency characteristics of the speaker unit using the speaker diaphragm according to the present embodiment of FIG. 13, a speaker diaphragm 112 before the pattern for the changed portions 91 shown in FIG. 11 was written with the laser exhibited a dip 113 at frequencies near 600 Hz, as shown by the dashed line. By contrast, in a speaker diaphragm 111 after the pattern for the changed portions 91 was written with the laser, it is seen that occurrence of the dip is suppressed at the frequencies near 600 Hz.

EXPERIMENT EXAMPLE 3

A speaker diaphragm used for analysis of Experiment Example 3 includes a perfect (or substantially perfect) circular cone similar to that of the speaker diaphragm used in Experiment Example 1 (e.g., used for the analysis shown in FIG. 2). However, this speaker diaphragm is larger in both outside diameter and thickness, with its outside diameter being 156 mm and its thickness being 0.45 mm.

By injection molding, a resin is charged into a mold from a gate similar to that of FIG. 2, to mold the cone as the speaker diaphragm. During this process, in the cone shown in FIG. 2B, due to its large thickness, the resin flows evenly toward the outer circumference of the cone from the gate located at the center. Thus, the direction of flow and orientation of the resin is a direction in which the resin spreads out evenly from the center to the outer circumference. This diaphragm was prepared by injection-molding a polyolefin composition.

The injection molding machine used is an ultrahigh-speed molding machine having the following specifications: the maximum injection pressure is 2,800 kg/cm$^2$; the maximum injection speed is 1,500 mm/sec; the rise speed is 10 msec; the mold clamping force is 160 tons; and the screw diameter is 432 mm. The resin used is a composition in which a fiber is combined with a special polyolefin resin, i.e., Lubmer L3000 (manufactured by Mitsui Chemicals Inc.), by which an oriented layer is readily formable when injected. This special polyolefin was prepared by subjecting an ultra-high molecular weight polyolefin and a high molecular weight olefin to multi-stage polymerization.

The resin was charged from a hopper of the injection molding machine under the following injection conditions. The temperature of a plasticizing screw section was 260° C.; the injection speed was 1,500 mm/sec; and the mold temperature was 45° C.

The injection molding was performed under the above conditions, and the resultant speaker diaphragm was then ejected, after which measurement was made as to its vibration modes.

Figure 14:
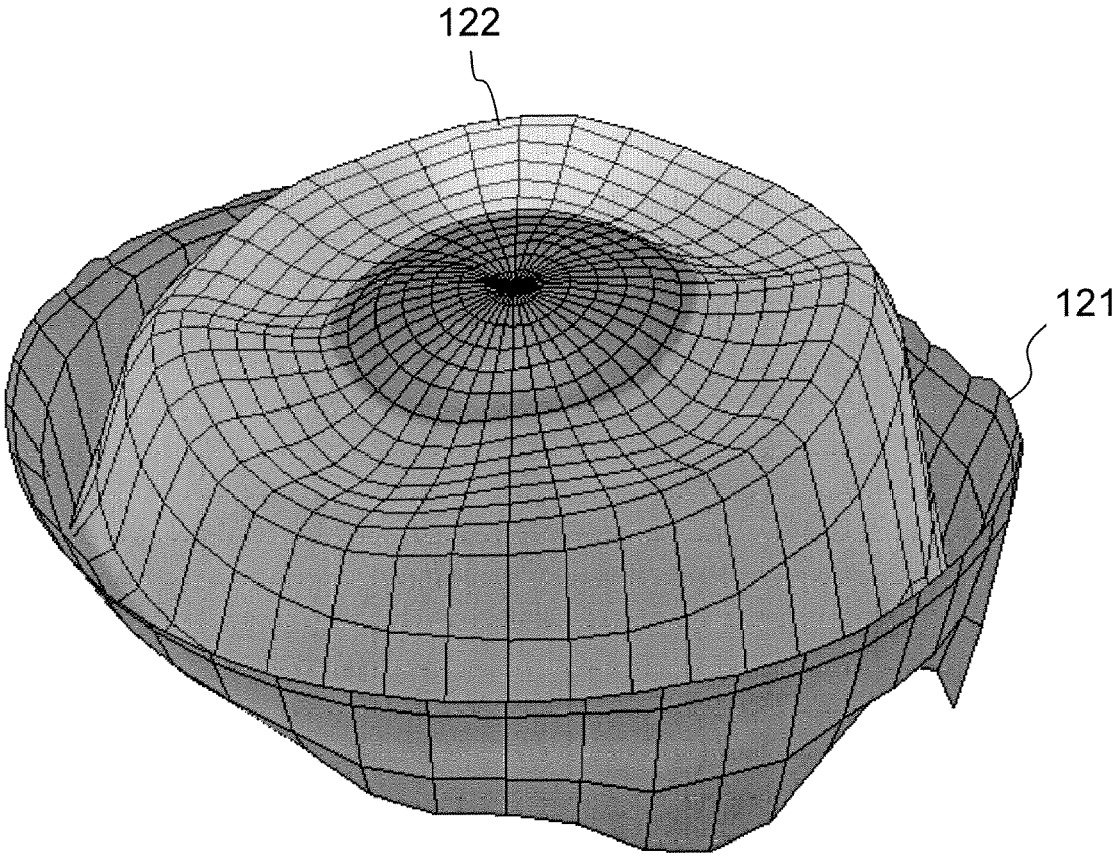
FIG. 14 is a diagram showing a vibration mode in a speaker unit using a speaker diaphragm with no changed portion.

FIG. 14 is a diagram showing a vibration mode in a speaker unit using the speaker diaphragm with no changed portion.

In FIG. 14, a circumferentially extending, relatively large, even peak 122 appears upward in the circumferential direction of a cone 121. The reason why the relatively large, even peak appears in this way is that the flow and orientation of the resin occur in the direction in which the resin spreads out evenly from the center toward the outer circumference so intensely that the vibration characteristics are not smoothed, resulting in local vibrations.

Through measurement of a vibration mode using the thus injection-molded speaker diaphragm, it was shown that partial vibrations such as seen from the peak shown in FIG. 14 had occurred in the radial direction, and hence it was decided to provide a geometric pattern for canceling these partial vibrations.

The geometric pattern for the changed portions is similar to that shown in FIG. 3, and thus its description will be omitted.

For example, the geometric pattern for the changed portions shown in FIG. 3 was provided on the speaker diaphragm. In the present embodiment, the pattern was formed by partially heating and pressing the cone using the marker 53 as the laser beam machine, under the machining conditions: the temperature was 100° C., and the pressure was 5 kg/cm$^2$. As a result, dips pitched at 0.2-0.5 mm were formed.

After the thus shaped changed portions were formed, vibration modes were measured.

Figure 15:
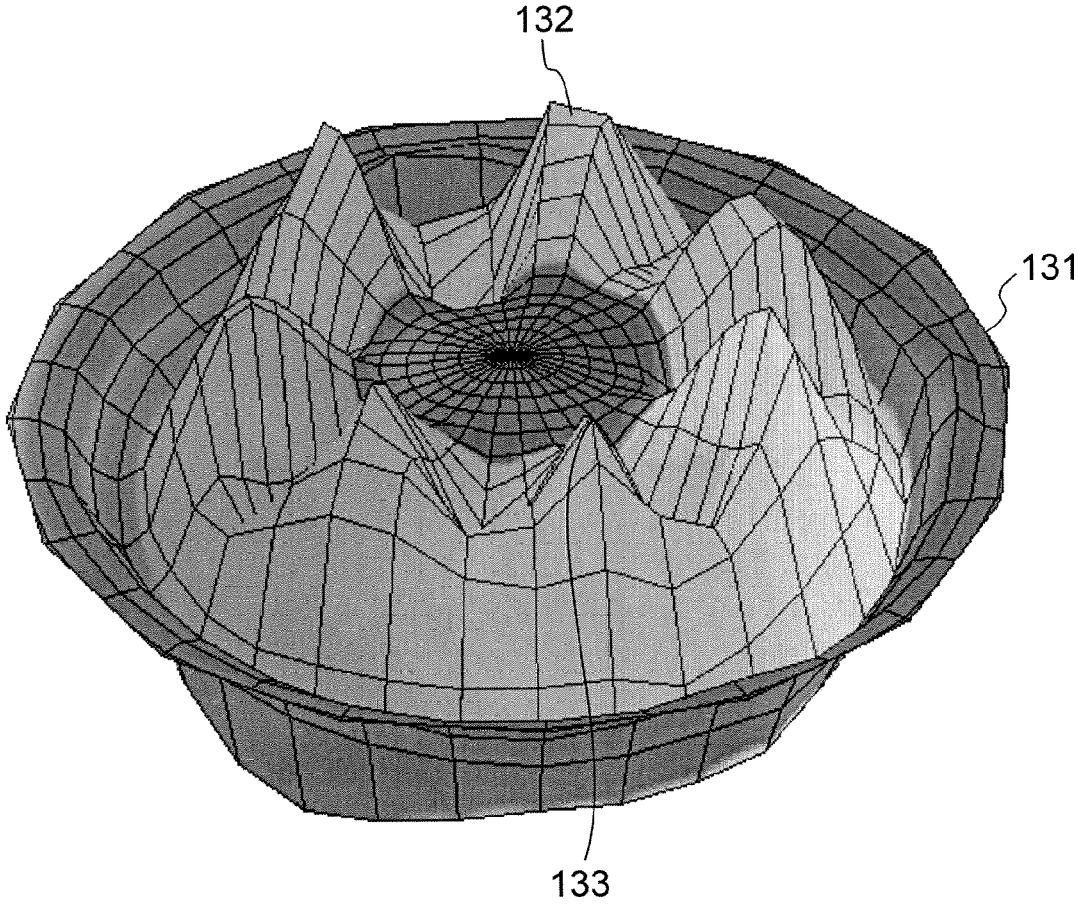
FIG. 15 is a diagram showing a vibration mode in a speaker unit using a speaker diaphragm with changed portions.

FIG. 15 is a diagram showing a vibration mode in a speaker unit using the speaker diaphragm with the changed portions.

In FIG. 15, two peaks 132, 133 as dispersed in relatively small amounts appear upward in the circumferential direction of a cone 131. The reason why the peaks appear as dispersed in relatively small amounts in this way is that, similarly to the example shown in FIG. 3, the changed portions are formed into a pattern in which a pattern element is repeated in a manner dividing the circumference of the cone 131 as the speaker diaphragm radially, according to the shape of the cone as the speaker diaphragm, to divide the local vibrations to smooth the vibration characteristics.

In the vibration mode in the speaker unit using the speaker diaphragm according to the present embodiment shown in FIG. 15, the partial vibration peaks are reduced compared to those in FIG. 14, from which it is seen that the effect of the present embodiment is realized.

Figure 16:
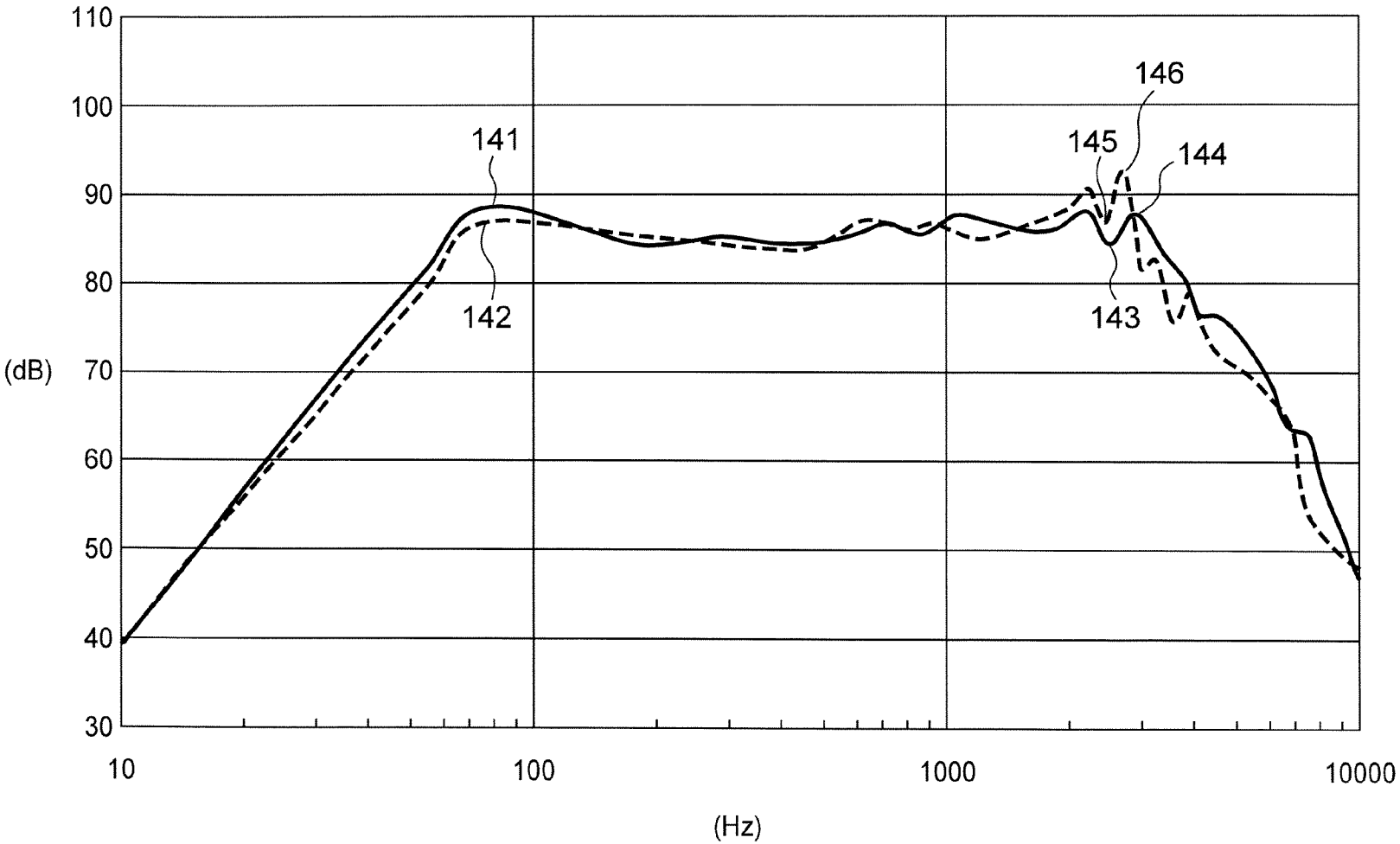
FIG. 16 is a diagram showing frequency characteristics of a speaker unit using a speaker diaphragm with changed portions.

FIG. 16 is a diagram showing frequency characteristics of the speaker unit using the speaker diaphragm with the changed portions.

As to the frequency characteristics of the speaker unit using the speaker diaphragm according to the present embodiment of FIG. 16, a speaker diaphragm 142 before the pattern for the changed portions similar to those of FIG. 3 was written with the laser exhibited a dip 145 and a peak 146 in a 2-5 kHz range, as shown by the dashed line. By contrast, in a speaker diaphragm 141 after the pattern for the changed portions was written with the laser, a dip 143 and a peak 144 appear with their difference being smaller in the 2-5 kHz range.

In this way, the speaker unit using the speaker diaphragm according to the present embodiment of FIG. 16 exhibits flatter frequency characteristics with the difference between the peak 144 and the dip 143 remarkably contained, compared to the frequency characteristics measured before the pattern was written by partial heating and pressing, and thus the effect of the present embodiment is manifested.

The present invention may not be limited to the above-mentioned embodiments, but may, of course, be suitably modified without departing from the scope and spirit of the invention set forth in the claims.

The present invention contains subject matter related to Japanese Patent Application JP 2005-211522 filed in the Japanese Patent Office on Jul. 21, 2005, the entire contents of which being incorporated herein by reference.

What is claimed is:

1. A speaker diaphragm comprising:

a cone made of a resin containing a thermoplastic polymeric material, the cone having an aperture at the apex and a cone surface extending from an edge of the aperture to an outer circumference of the cone, the cone shaped with a manufacturing mold configured to allow the resin to flow radially from the aperture to the outer circumference of the cone; and a changed portion formed within a geometric pattern in and on the cone surface, the changed portion including a plurality of peaks and valleys in and on the cone surface, the plurality of peaks and valleys being separated by a sub-millimeter fixed pitch distance, the changed portion having a Young's modulus different than the cone surface outside the geometric pattern, the changed portion configured to smooth a characteristic of local vibrations.

2. The speaker diaphragm according to claim 1, wherein:

the changed portion is formed into a the geometric pattern as to divide a circumference of the diaphragm in a radial direction, the geometric pattern being located on the cone surface based on the characteristic of local vibrations which are measured in advance on the cone without the changed portion.

3. The speaker diaphragm according to claim 2, wherein:

the diaphragm is formed in a circular shape; and a plurality of the changed portions are disposed evenly in a manner dividing a circumference of the diaphragm in a radial direction.

4. The speaker diaphragm according to claim 2, wherein:

the diaphragm is formed in an elliptic shape; and a plurality of the changed portions are disposed at locations along a direction toward foci in a manner dividing a circumference of the diaphragm in a radial direction.

5. The speaker diaphragm according to claim 2, wherein:

the changed portion is formed so as to have a width thereof maximized on an outer circumferential side and minimized on an inner circumferential side of the diaphragm, and the sub-millimeter fixed pitch distance is within a range of 0.2 millimeters to 0.5 millimeters.

6. The speaker diaphragm according to claim 5, wherein:

the changed portion is formed so as to have a base thereof on an outer circumferential side and a vertex thereof on an inner circumferential side of the diaphragm, and the changed portion having a Young's modulus less than that of the cone surface outside of the geometric pattern.

7. The speaker diaphragm according to claim 1, wherein:

a carbon dioxide laser is used to form the changed portion.

8. The speaker diaphragm according to claim 1, wherein:

partial heating is performed to form the changed portion.

9. The speaker diaphragm according to claim 1, wherein:

the diaphragm is molded by injection-molding a polyolefin composition containing an ultra-high molecular weight polyolefin.

10. A method of manufacturing a speaker diaphragm made of a resin containing a thermoplastic polymeric material, the method comprising:

molding the diaphragm having a center aperture and an outer diaphragm perimeter using the thermoplastic polymeric material, the resin flowing through the mold from the center aperture to the outer diaphragm perimeter;

measuring a characteristic of local vibrations of the molded diaphragm;

determining several parameters to smooth the characteristic of local vibrations, the several parameters including a geometric pattern of a changed portion upon a portion of the diaphragm, a location of the geometric pattern relative to the diaphragm, and at least one laser irradiating condition; and forming the changed portion by irradiating the portion of the diaphragm with a laser beam within the geometric pattern, the at least one laser irradiating condition creating a plurality of peaks and valleys having a sub-millimeter fixed pitch distance in and on the surface of the diaphragm and a reduced Young's modulus of the thermoplastic polymeric material within the geometric pattern.

11. A speaker unit for acoustic output, the speaker unit comprising:

a conical diaphragm made of a resin containing a thermoplastic material, the diaphragm having an aperture at the apex and a diaphragm surface extending from the aperture to the outer circumference of the diaphragm, the conical diaphragm configured to allow the resin to flow radially from the aperture to the outer circumference of the diaphragm, the diaphragm having a changed portion in and on a portion of the diaphragm surface defined within a geometric pattern, the changed portion having partially changed physical properties of the thermoplastic polymeric material and a plurality of peaks and valleys in and on the diaphragm surface within the geometric pattern, the plurality of peaks and valleys being separated by a sub-millimeter fixed pitch distance, and the changed portion configured to smooth a characteristic of local vibrations which are measured in advance on the diaphragm without the changed portion;

a center cap attached to the diaphragm and configured to prevent deformation of the diaphragm in a radial direction;

a voice coil configured to move up and down around a pole to vibrate the diaphragm;

a damper configured to hold the voice coil around a pole; and a frame configured to be attached to the base of the diaphragm.

12. The speaker unit according to claim 11, wherein:

the geometric pattern is triangular so as to have a base thereof on an outer circumferential side and a vertex thereof on an inner circumferential side of the diaphragm, and the changed portion having a Young's modulus less than that of the diaphragm surface outside of the geometric pattern.

* * * * *